US008997728B2

(12) United States Patent
Popov et al.

(10) Patent No.: US 8,997,728 B2
(45) Date of Patent: Apr. 7, 2015

(54) DOUBLE BOW SYSTEM

(76) Inventors: Sergey Olegovich Popov, Moscow (RU); Pavel Vitalievich Ivanov, Moscow (RU); Sergey Anatolievich Golovatyy, Moscow (RU)

( * ) Notice: Subject to any disclaimer, the term of this patent is extended or adjusted under 35 U.S.C. 154(b) by 566 days.

(21) Appl. No.: 12/675,119

(22) PCT Filed: Sep. 9, 2008

(86) PCT No.: PCT/RU2008/000589

§ 371 (c)(1),
(2), (4) Date: Feb. 24, 2010

(87) PCT Pub. No.: WO2009/035376

PCT Pub. Date: Mar. 19, 2009

(65) Prior Publication Data

US 2011/0056467 A1 Mar. 10, 2011

(30) Foreign Application Priority Data

Sep. 16, 2007 (RU) ..... 2007135309

(51) Int. Cl.

| | |
|---|---|
| ***F41B 5/12*** | (2006.01) |
| ***F41B 5/00*** | (2006.01) |
| ***F41B 5/10*** | (2006.01) |
| ***F41B 5/14*** | (2006.01) |

(52) U.S. Cl.
CPC ..... *F41B 5/123* (2013.01); *F41B 5/0094* (2013.01); *F41B 5/10* (2013.01); *F41B 5/1469* (2013.01)

(58) Field of Classification Search
USPC ..... 124/25.6, 25, 25.5, 900
See application file for complete search history.

(56) References Cited

U.S. PATENT DOCUMENTS

| | | | | |
|---|---|---|---|---|
| 1,932,195 | A * | 10/1933 | Stroup | 124/22 |
| 3,854,467 | A * | 12/1974 | Hofmeister | 124/25.6 |
| 4,457,288 | A * | 7/1984 | Ricord | 124/25.6 |
| 4,722,317 | A * | 2/1988 | Hartwig | 124/25.6 |
| 7,047,958 | B1 * | 5/2006 | Colley | 124/25.6 |
| 7,891,348 | B2 * | 2/2011 | Colley | 124/25 |
| 2005/0279338 | A1 * | 12/2005 | Dziekan | 124/25 |
| 2006/0144381 | A1 * | 7/2006 | Kempf et al. | 124/25 |

* cited by examiner

*Primary Examiner* — Alvin Hunter
*Assistant Examiner* — Amir Klayman
(74) *Attorney, Agent, or Firm* — Bardmesser Law Group

(57) ABSTRACT

This invention belongs to the group of projectile throwing instruments working without an explosive or a combustible propelling charge in particular to the group of projectile throwing instruments using strained hard body energy and can be used for the design and construction of a missile throwing weapon using a string—namely a bow and cross-bow.

7 Claims, 3 Drawing Sheets

DOUBLE BOW SYSTEM

This invention belongs to the group of projectile throwing instruments working without an explosive or a combustible propelling charge in particular to the group of projectile throwing instruments using strained hard body energy and can be used for the design and construction of a missile throwing weapon using a string—namely a bow and crossbow.

There is a crossbow with a double bow system (Pub. No.: US 2005/0279338 A1) that has a gunstock with a cocking lever, triggering mechanism, and thrower that looks like a double bow. The mentioned double bow system has limbs with four free ends on which two front and two back rollers are located. The mentioned limbs are freely connected by means of male screw with a central channel, bearing the preparatory cocking mechanism in such a way that the string's first end is affixed onto the preparatory cocking mechanism from the side that is nearest to the second limb, from where the string is stretched to the first roller of the first limb and then diagonally to the back roller of the second limb, and then to the back roller of the first limb, from where it is directed diagonally to the front roller of the second limb and then its second end is affixed onto the preparatory cocking mechanism from the side that is nearest to the first limb.

The drawback of the double bow system is the short power stroke in comparison with the total length of the crossbow. This is caused by the fact that the entire double bow system is located on the front area of the string's move, which is necessary for shooting. Such a placement of the double bow system increases the crossbows length and negatively affects its balancing.

The significant drawback of the mentioned double bow system is also the string's diagonal crossing, which creates an additional point of friction and does not allow for the placement of the double bow system on the surface parallel to that of the string movement during shooting. As a result, the force during the shooting moment is divided into additional components that lead to a decrease of the starting speed of the thrown missile. Besides, it is impossible to create an independent bow design by using the mentioned double bow system.

The technical task that is to be solved by means of this invention consists in the creation of bow and crossbow constructions with a double bow system that is free from the mentioned drawbacks.

The technical result of the project's realization sets out to increase the thrown missile's starting speed, shooting's accuracy and density, decrease the size, improve the balance and ergonomics, as well as make the exploitation simple.

To achieve the mentioned technical result, we suggest using a double bow system containing limbs that are to be placed on their attachment point with four free ends on which the string path joints are attached wherein the working string passes through them for the throwing of the missile. Furthermore, the double bow system additionally contains at least two points of the string's turn-away that are placed on the limbs attachment point, in which the string is placed on the passing point in such a way that it has no diagonal crossing and the surface perpendicular to the surface of the limbs location and passes through the limbs symmetry axis across the string in once. The string passing point and string's turn-away point can be made as a cam or roller. Additionally, the roller represents a spinning cylinder along the circular of which at least one peripheral surface that is shaped as a string's channel or cable string's channel can be located. The cam represents the spinning part of the wheel's shape or of a complex, non-round shape including one with a shifted spinning axis along the circular of which there is at least one peripheral surface that is shaped like a string channel and\or cable string channel. The string's ends can be affixed onto the spinning axis of the string's turn-away points, on additionally installed string attachment members that are to be placed on the string's spinning axis, on the string's turn-away points, on the string's passing points, on the string's attachment members, as well as placed on the spinning axis of the string's passing points. The abovementioned list does not limit the possible ways for affixing the string. To increase the speed of the thrown missile, the designed double bow system may additionally contain at least two cable strings that are to be placed on the string's passing points and the string's turn-away points in such a way that they do not intercross diagonally. In addition, the surface that is perpendicular to the surface of the limbs location and passing through the limbs symmetry axis does not cross the cable strings. In the preferable variant of the realization of the string's passing point and the string's turn-away point (whether they are represented as a roller or cam) have at least one peripheral surface that is designed for the string's and\or cable string's passing. The string's passing point and the string's turn-away point can have a spinning axis that is shifted from the center and have a round or non-round shape. In the designed version of the double bow system, the limb can be made and\or fixed in such a way that the stiffness of one of its ends is higher than that of the other. In particular, this can be achieved owing to the different length of the ends concerning the point of attachment, to the different thicknesses along the free parts of the limb, and also owing to the different physical properties of the used materials. The limb can be either solid or compound.

The string's turn-away points are located at the opposite sides of the limbs symmetry axis and are to be placed on the limbs point of attachment. The elements for the string's fixation, in particular, the parts having a surface for the string's fixation and attachment means to one of the mentioned points can be used.

The designed technical solution can have a few variants of the realization for crossbows and bows.

In the first variant of the crossbow's design realization, the double bow system represents a separable unit and is placed on the barrel in such a way that all the double bow system's components are placed inside the area of the string's working path, which allows for a significant lessening of the crossbow's length and an increase of power stroke. The surface of the limbs location is parallel to the surface of the barrel placement. The limbs point of attachment is located at the lower part of the barrel near the triggering mechanism and can be centered in regard to the crossbow's usage by means of the cone that is made on the upper surface of the limbs point of attachment into the response cone hollow of the barrel and is attached at least with one threaded coupling that allows for the improvement of the crossbow's balance and makes its assembling and disassembling extremely simple.

In the second variant of the crossbow's design realization, the double bow system represents a separable unit and is placed on the barrel in such a way that all the double bow system's components are placed out of the area of the string's working path and the surface of the double bow's placement is parallel to the directing surface of the barrel. Such a position of the double bow system owing to the movement of the limbs ends allows for an increase in the starting speed of the thrown missile during the shooting.

In both variants of the crossbow design realization, it is possible to place the string's turn-away points on the crossbow's barrel.

Both variants of the double bow system's placement for the mentioned crossbow designs also can be used for designing of bows.

Furthermore, some particular cases of the present invention that are used for bow and crossbow design will be described in detail by using the diagrams:

Figure 1:
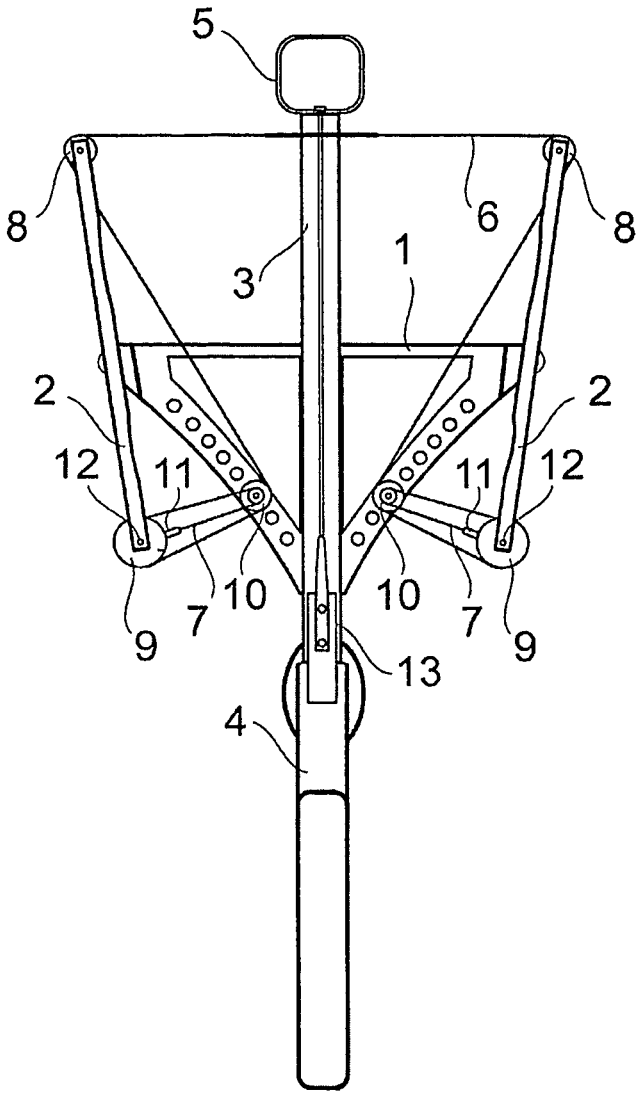
FIG. 1 shows the top view of the crossbow containing the double bow system according to the first variant of the technical solution's realization.
Figure 2:
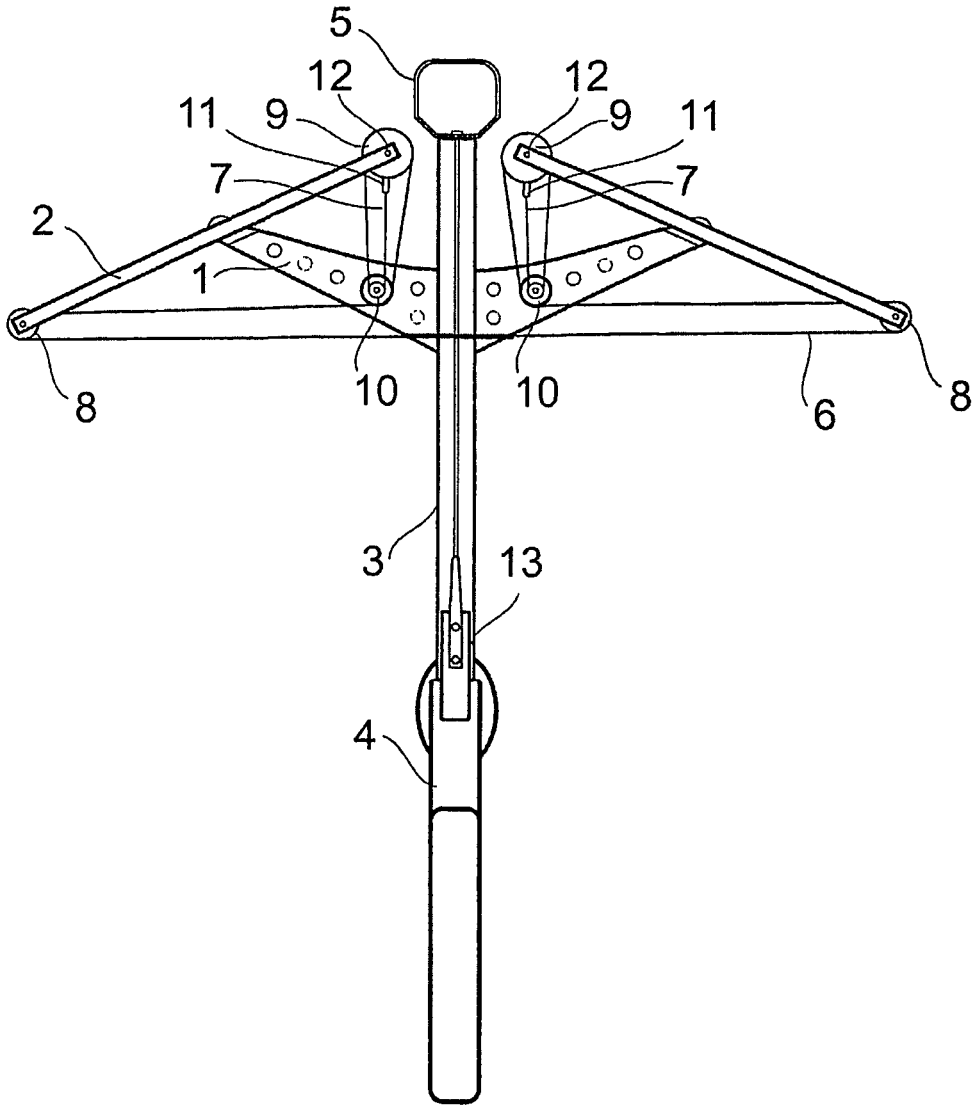
FIG. 2 shows the top view of the crossbow containing the double bow system according to the second variant of the technical solution's realization.
Figure 3:
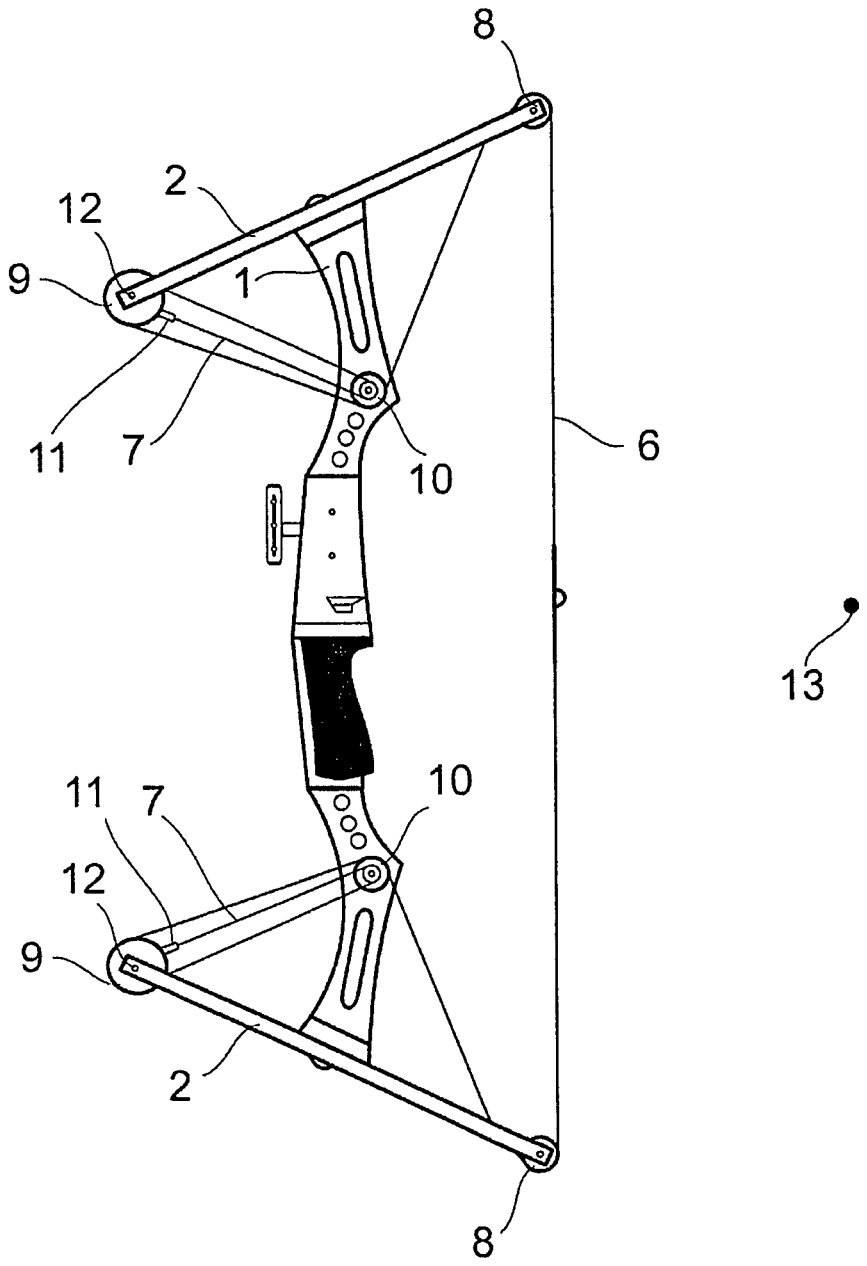

FIG. 3 shows the top view of the bow containing the double bow system according to the second variant of the technical solution's realization. Moreover, the following legends are used: attachment point of the limbs 1, limbs 2, barrel 3 (sometimes referred to as "tiller" in the art), stock 4, foot stirrup 5, string 6, cable strings 7, string's passing point made as a roller 8, string's passing point made as a cam 9, string's turn-away point made as a roller 10, string's fixation element 11, spinning axis 12, string's fixation point 13.

In the variants of the design's realization that are represented in the pictures, the projectile throwing instruments with the double bow system are used as follows: with force being applied string 6 is pulled towards its fixation point 13. All four free ends of the limbs 2 bend and store energy that is necessary for shooting; the string's passing points made as rollers 8 allowing the string 6 to spin, the string's passing points that are made as cams 9 have two peripheral surfaces that turn around the spinning axis 12 unwinding the string 6; at the same time the cable strings 7 are wound on the string's passing points that are made as cams 9. When the string is fixed in the point of the string's fixation 13, the thrower is ready for shooting.

The use of the mentioned technical solution allows for an increase in the maximum starting speed of the thrown missile by approximately 25%, the accuracy and density of the shooting by approximately 15%, and at the same time to decrease the size by 30%. At the same time, this allows for the improved balance and ergonomics as well as to simplify the thrower's operation.

The invention claimed is:

1. A crossbow comprising:

a string;

a tiller for mounting and directing a projectile, wherein the projectile is fired substantially along the tiller when the string is released;

a frame attached to the tiller and having a first wing and a second wing;

a first limb attached on an end of the first wing at a distance from the tiller, the first limb having a first free end and a second free end with a first placing means for positioning the string and a second placing means for positioning the string installed on respective free ends of the first limb;

a second limb attached on the end of the second wing at a distance from the tiller, the second limb having a first free end and a second free end with a first placing means for positioning the string and a second placing means for positioning the string installed on respective free ends of the first limb;

at least one deflecting means for pulling the string from the first placing means and the second placing means of the first wing, the at least one deflecting means disposed on the first wing between the tiller and the first limb;

at least one deflecting means for pulling the string from the first placing means and the second placing means of the second wing, the at least one deflecting means disposed on the second wing between the tiller and the second limb, wherein the string passes at least over the first placing means, the second placing means and the at least one deflecting means in the following sequence: the second placing means of the first limb, the deflecting means of the first wing, the first placing means of the first limb, the first placing means of the second limb, the deflecting means of the second wing, the second placing means of the second limb, and wherein the string crosses a path of the projectile only once.

2. The crossbow of claim 1, wherein at least one of the first placing means, the second placing means, and the deflecting means are rollers.

3. The crossbow of claim 1, wherein the limbs are attached to the frame so that stiffness of one of the ends is higher than stiffness of the other one of the ends.

4. A crossbow comprising:

a string and at least two cables, wherein the string and at least two cables are connected in series;

a tiller for resting and directing a projectile, wherein the projectile is fired substantially along the tiller when the string is released;

a frame attached to the tiller and having a first wing and a second wing;

a first limb attached on an end of the first wing at a distance from the tiller, the first limb having a first free end and a second free end with installed thereon respectively a first placing means for positioning the string and/or at least two cables and a second placing means for positioning the string and/or at least two cables;

a second limb attached on an end of the second wing at a distance from the tiller, the second limb having a first free end and a second free end with installed thereon respectively a first placing means for positioning the string and/or at least two cables and a second placing means for positioning the string and/or at least two cables;

at least one deflecting means for pulling the string and/or at least two cables from the first placing means and the second placing means of the first wing, the at least one deflecting means disposed on the first wing between the tiller and the first limb;

at least one deflecting means for pulling the string and/or at least two cables from the first placing means and the second placing means of the second wing, the at least one deflecting means disposed on the second wing between the tiller and the second limb, wherein the string and at least two cables pass at least over the first placing means, the second placing means and the at least one deflecting means in the following sequence: the second placing means of the first limb, the deflecting means of the first wing, the first placing means of the first limb, the first placing means of the second limb, the deflecting means of the second wing, the second placing means of the second limb, and wherein the string crosses a path of the projectile only once while the at least two cables do not cross the path of the projectile.

5. The crossbow of claim 4, wherein at least one of the first placing means, the second placing means, and the deflecting means are rollers.

6. The crossbow of claim 4, wherein at least one of the first placing means, the second placing means, and the deflecting means are cams.

7. The crossbow of claim 4, wherein the limbs are attached to the frame so that stiffness of one of the ends is higher than stiffness of the other one of the ends.

* * * * *